US006331337B1

(12) United States Patent
Osborn et al.

(10) Patent No.: US 6,331,337 B1
(45) Date of Patent: Dec. 18, 2001

(54) BONDING BUILDING BLOCKS USING ADHESIVE TAPES

(76) Inventors: Bryan Woodrow Osborn, 407 Mignon St., Houston, TX (US) 77024; Jay Dwain Etheredge, 1007 Briarwild La., Houston, TX (US) 77080

( * ) Notice: Subject to any disclaimer, the term of this patent is extended or adjusted under 35 U.S.C. 154(b) by 0 days.

(21) Appl. No.: 09/482,600

(22) Filed: Jan. 14, 2000

(51) Int. Cl.[7] ..... B32B 3/00

(52) U.S. Cl. ..... 428/61; 52/747.1; 156/182; 156/185; 156/214; 156/304.3

(58) Field of Search ..... 156/182, 214, 156/185, 304.3; 428/61; 52/747.1

(56) References Cited

U.S. PATENT DOCUMENTS 2,197,132 * 4/1940 Lougheed ..... 428/61

4,774,793 * 10/1988 Mayer ..... 52/747.1

FOREIGN PATENT DOCUMENTS

1099714 * 1/1968 (GB) ..... 156/304.3

* cited by examiner

*Primary Examiner*—John J. Gallagher
(74) *Attorney, Agent, or Firm*—Michael P. Breston

(57) ABSTRACT

The method of this invention concerns bonding side-to-side glass or plastic building blocks to obtain decorative and/or functional modular sub-assemblies, walls, panels, floors, windows, skylights, etc., using flexible, light-weight, elongated, adhesive tape strips to adhesively bond together at least portions of complementary block side surfaces to construct multi-tier building block units.

22 Claims, 7 Drawing Sheets

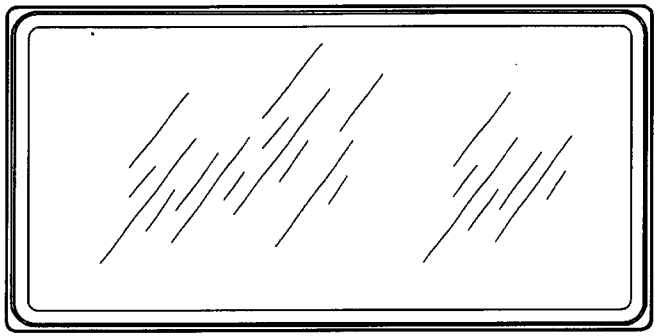
FIG.2A
FIG.2B
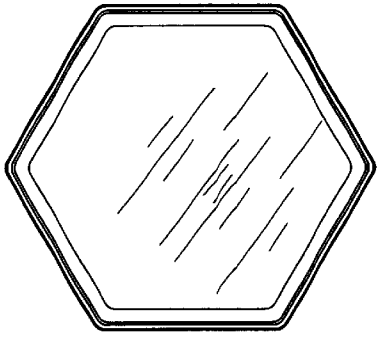
FIG.2C
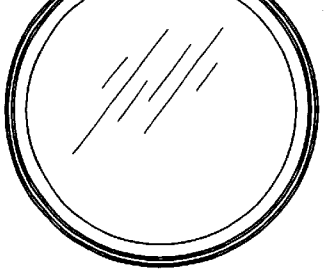
FIG.2D
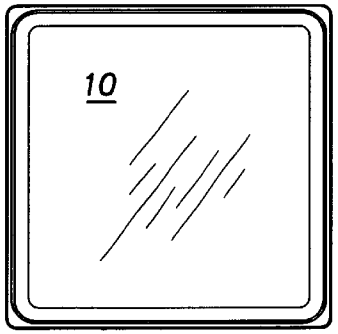
FIG.2E
FIG.2F
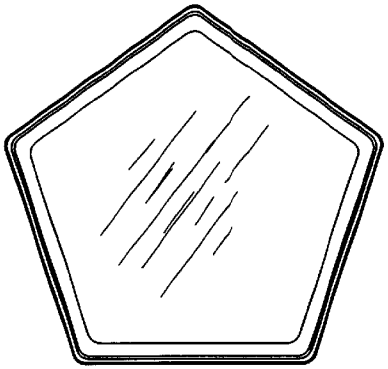
FIG.2G

BONDING BUILDING BLOCKS USING ADHESIVE TAPES

BACKGROUND OF THE INVENTION

1. Field of the Invention

The technical field primarily concerns permanently bonding side-to-side glass or plastic building blocks to obtain decorative and/or functional modular sub-assemblies, walls, panels, floors, windows, skylights, etc.

2. Description of the Known Prior Art

The conventional methods for bonding such building blocks employ bonding compositions, such as mortar, cement, grout, caulking and/or silicone. At least for commercial applications, mortar still remains the prevailing bonding medium. Optionally, a silicone or grout sealant is typically applied over each mortar joint to seal it against mold or mildew.

As judged architecturally, aesthetically and structurally, the quality of such glass block units depends to a large extent on the uniform alignment of the mortar joints within a common row and between successive rows in horizontal and vertical directions. Such uniform joint alignments depend, among other things, on the volume of mortar the installer spreads on and around each glass block.

Since the mortar volume is generally "eye-balled", obtaining consistent joint alignments becomes a challenge even for the expert artisan. Do-it-yourselfers fear joint misalignments which might make their finished glass block panels or walls structurally and aesthetically unreliable. Such joint uniformity is necessary within a completed glass block unit to make it structurally sound and pleasing in appearance.

Also, the use of mortar adds considerable weight to a glass block assembly and reduces the construction speed since only a limited amount of mortar can be mixed, as the mortar's curing time controls the speed of assembly and finish. The number of courses of blocks that can be laid up at a time is also reduced due to the concern that the excessive weight of the freshly laid up blocks in the upper rows may squeeze the mortar out from the fresh mortar joints in the lower rows.

It is evident, therefore, that the known mortar methods for assembling glass/plastic blocks require skilled artisans to properly align their completed mortar joints, and to maintain the joints' width uniform during the whole installation leading to a completed building block unit.

Also, such known mortar methods can create serious health hazards from prolonged exposure to conventional bonding and sealing materials: mortar, cement, grout, caulking and/or silicone. They tend to generate dust and release chemical gases, all of which in accumulation can produce lasting injuries to block laying artisans and others on the worksite. As a consequence, builders were discouraged from extensively using glass and/or plastic blocks except for relatively expensive custom homes and overhead applications such as skylights.

To obviate some of such adverse effects, many patents suggest using separate rigid interlocked spacers for aid in forming grid-like structures intended to surround and maintain the individual glass or plastic blocks.

In particular, U.S. Pat. No. 5,430,985 describes longitudinal spacers 10 for enclosing the center ridges 76 that extend peripherally around and between the lateral faces of the glass blocks. Each spacer 10 has opposite longitudinal center sections. Each section has a rectangular, longitudinally-extending groove 42 dimensioned to receive an opposite glass block center ridge 76. Fasteners 50 mechanically interconnect adjacently positioned spacers 10. Pressure-sensitive, adhesive-coated foam bands 44 are used for aligning grooves 42 relative to their opposite block center ridges 76. Abutting glass blocks 72, spacers 10, and fasteners 50 are permanently bonded to one another using mortar or silicone compositions.

It is a main object of this invention to use light-weight, action-activatable adhesive tapes to adhesively bond building blocks and to provide a relatively fast, easy, clean, and economical method for producing single or multi-tier building block units, wherein each block remains strongly bonded side-to-side to its abutting blocks, and wherein the inter-block joints have a uniform width dimension determined mostly by the thickness of the used adhesive tapes.

It is another object of this invention to overcome the above mentioned and other undesirable effects associated with the prior art mortar and mortarless methods for bonding building blocks, generally, and in particular for bonding blocks made of glass or plastic.

SUMMARY OF THE INVENTION

The method of this invention relates to bonding building blocks, each having a pair of opposite spaced-apart lateral faces and side faces therebetween, to create multi-tier building block units. Flexible, light-weight, elongated, adhesive tape strips, whose potency is responsive to a sufficient pressure force, bond the adhesive tape strips to at least portions of complementary side surfaces, thereby creating inter-block tape joints. The applied pressure force is maintained for a time needed to activate the curing of the adhesive within the inter-block joints. Preferably, the building blocks are made of a glass or other suitable material.

A multi-tier building block unit made in accordance with this invention includes a plurality of building blocks, each having a pair of opposite spaced-apart lateral faces and side faces therebetween. Adhesive tape strips bond portions of each block's complementary side surfaces so as to form inter-block tape joints, each having a width corresponding to the thickness of the tape strips, and each tape strip serves as the sole bond within its joint.

BRIEF DESCRIPTION OF THE DRAWINGS

The novel features believed to characterize the invention are set forth in the appended claims. The invention itself, however, as well as other features and advantages thereof, will be best understood by reference to the detailed description which follows, read in conjunction with the accompanying drawings, wherein:

FIGS. 2A–2G are front views of various shapes of common building blocks;

DESCRIPTION OF PREFERRED EMBODIMENTS

Figure 1:
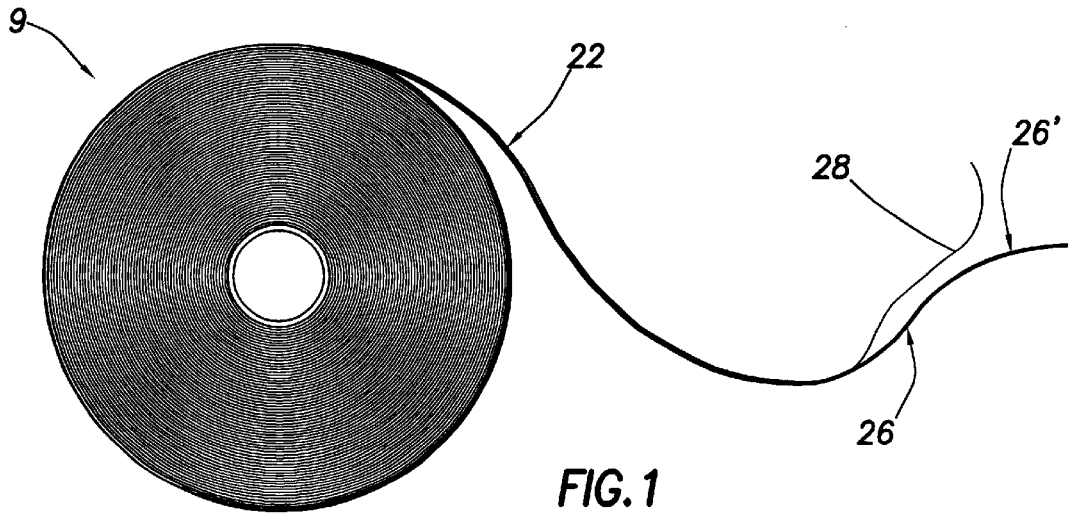
FIG. 1 is a top view of a roll of pressure sensitive tape.

In the drawings, to facilitate the description, the same or similar parts, functioning in the same or similar manner, are designated with the same numerals.

Figure 3:
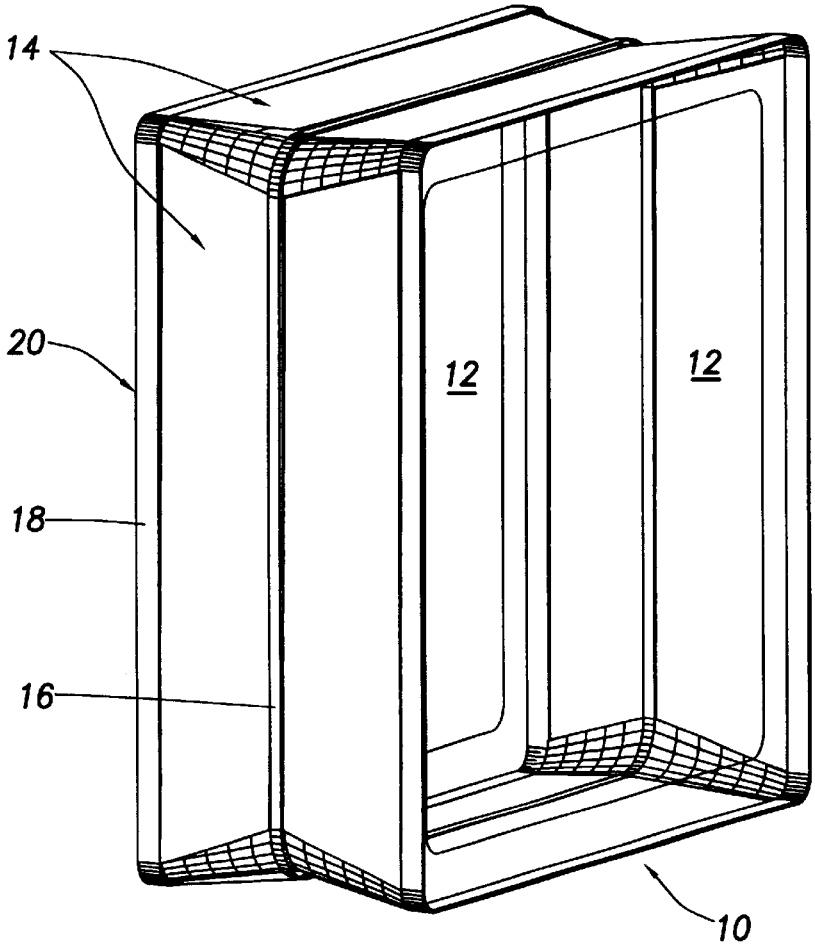
FIG. 3 is a perspective view of an untaped square block shown in FIG. 2E.
Figure 4A:
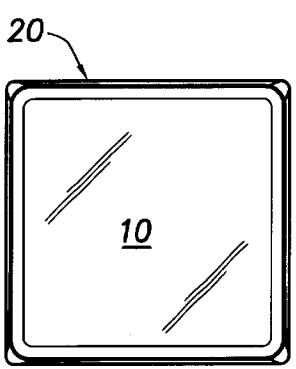
FIGS. 4A–4H illustrate the steps used to fully tape up the square block shown in FIG. 2E.
Figure 4B:
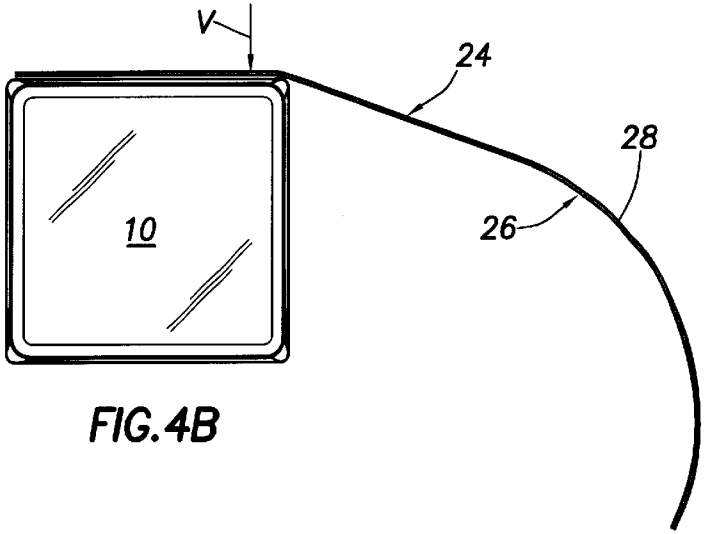
Figure 4C:
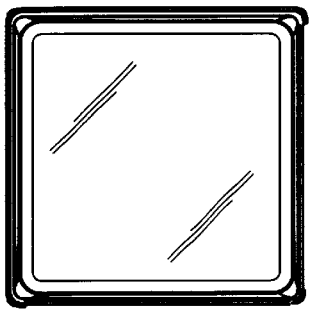
Figure 4D:
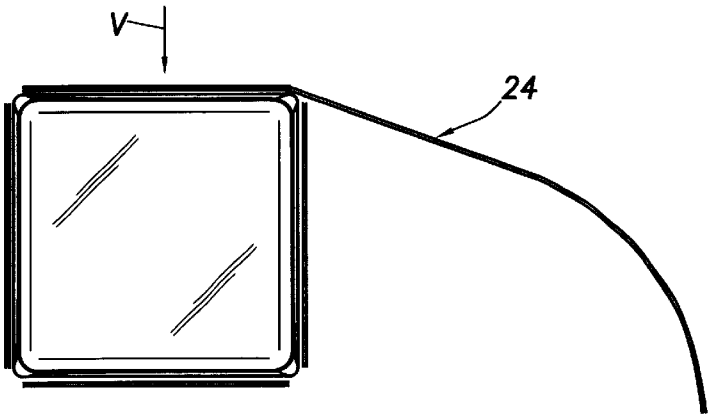
Figure 4E:
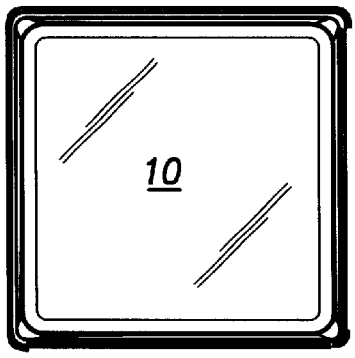
Figure 4F:
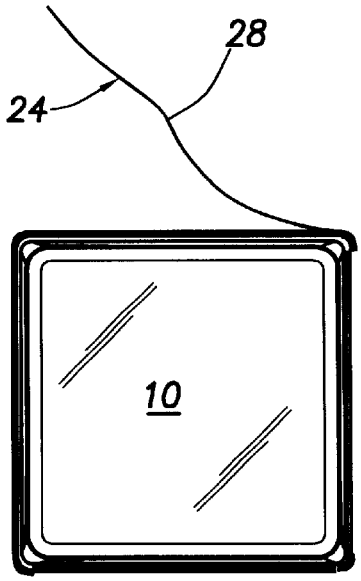
Figure 4G:
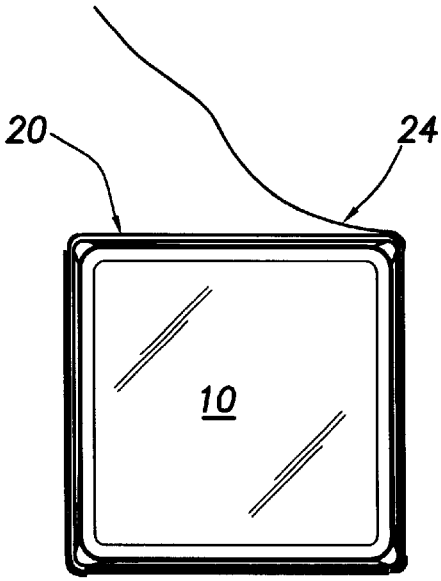
Figure 4H:
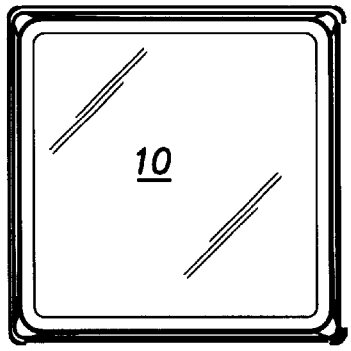

The following description deals primarily with the most common generally rectangular or square building blocks 10 (FIGS. 2E, 3). With appropriate modifications the description applies equally to less commonly used building block shapes: octagonal (FIG. 2A), rectangular (FIG. 2B), hexagonal (FIG. 2C), triangular (FIG. 2D), circular (FIG. 2F) and pentagonal (FIG. 2G). The blocks 10 can be made of glass or plastic or other materials used for constructing finished building block units 11.

Figure 5:
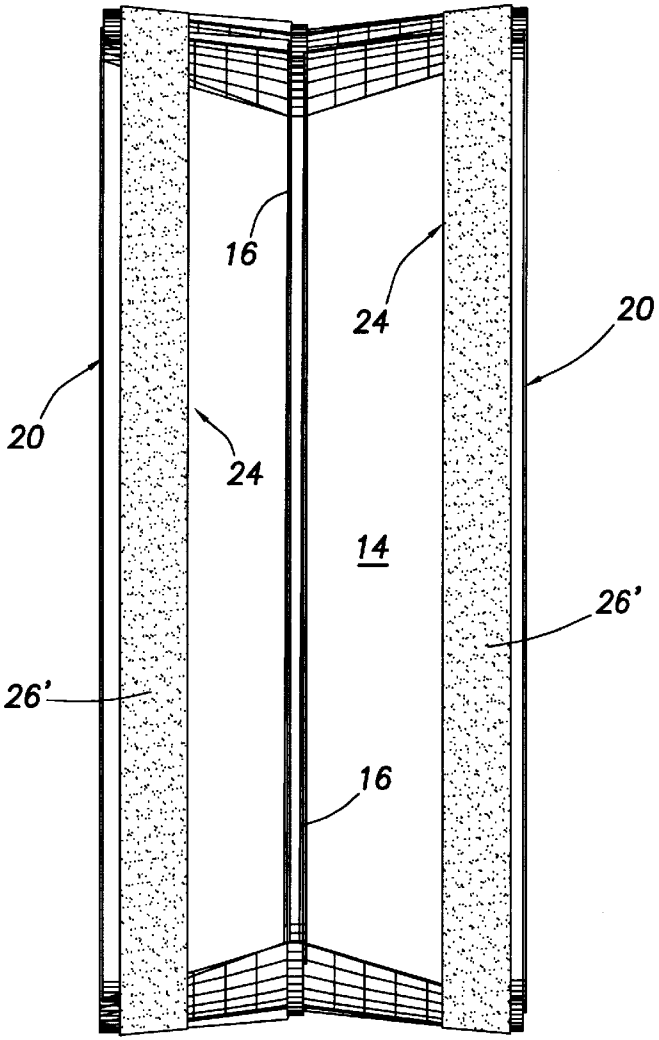
FIG. 5 is an end view of the fully taped up square block shown in FIG. 3.
Figure 6A:
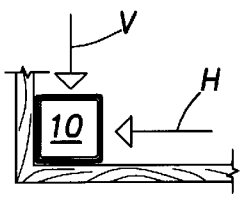
FIG. 6 illustrates the on site construction of a double-tape-joint, three course window unit using the square taped up blocks shown in FIG. 5.
Figure 6B:
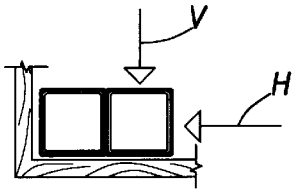
Figure 6C:
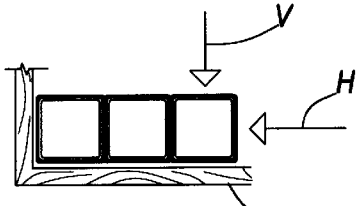
Figure 6D:
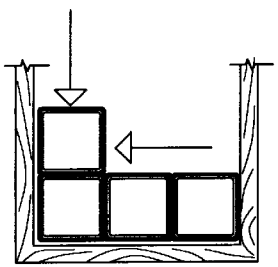
Figure 6E:
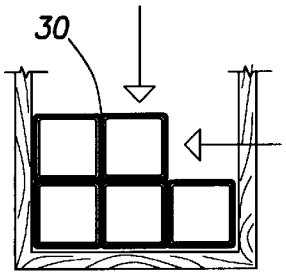
Figure 6F:
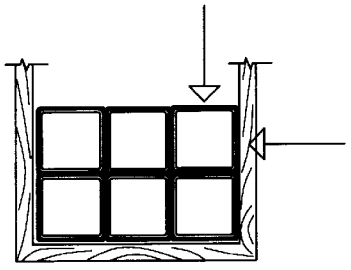
Figure 6G:
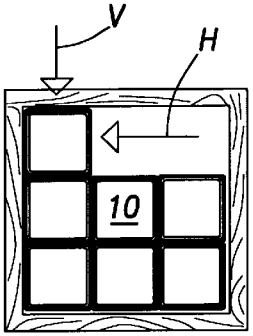
Figure 6H:
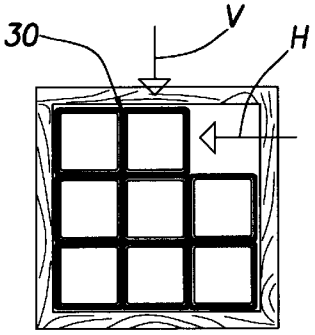
Figure 6I:
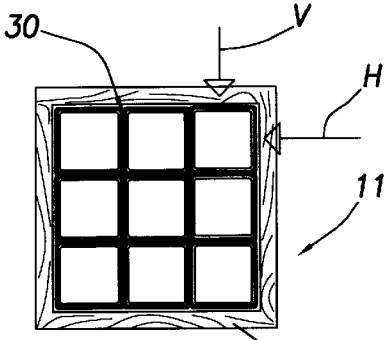

Each square block 10 (FIGS. 3, 5, 8) has a pair of opposite, square or rectangular, parallel, spaced-apart, lateral faces 12 and four side faces 14 therebetween. An outwardly-extending, circumferential center ridge 16 extends peripherally around and midway between the block's lateral faces 12.

Each peripheral edge of each lateral face 12 includes an outwardly-projecting rim 20: four rims 20 for a rectangular or square lateral face 12, and three rims 20 for a triangular lateral face 12. Each rim 20 exhibits a substantially flat exterior rim surface or face 18 lying in a plane substantially perpendicular to the planes of the block's lateral faces 12.

Although many types of adhesive tapes, generally designated as 22 (FIG. 1), may be employed, it has been found that pressure-activatable or pressure-sensitive adhesive tapes have sufficient strength and are most effective for carrying out the objects of this invention.

Presently preferred pressure-activatable adhesive tapes 22 are commercially available from the Minnesota Mining & Manufacturing Co. (3M) of St. Paul Minn. as well as others, in rolls or sheets in different colors, width and thickness, under the trade names "Scotch Brand" Acrylic Foam Tapes having designations "4945", "4946" and "VHF-4950".

It is believed that the pressure-activatable adhesive consists of an acrylic copolymer matrix and of glass microbubbles dispersed throughout the matrix, and that such or similar pressure-activatable adhesive tapes are described in U.S. Pat. No. 4,223,067, assigned to 3M. (It should be understood, however, that this invention is not limited to any particular type of adhesive tape nor to a particular action for activating the tape.) Preferably, the tape strips' adhesive is pressure-activatable and tacky at room temperature.

Figure 8:
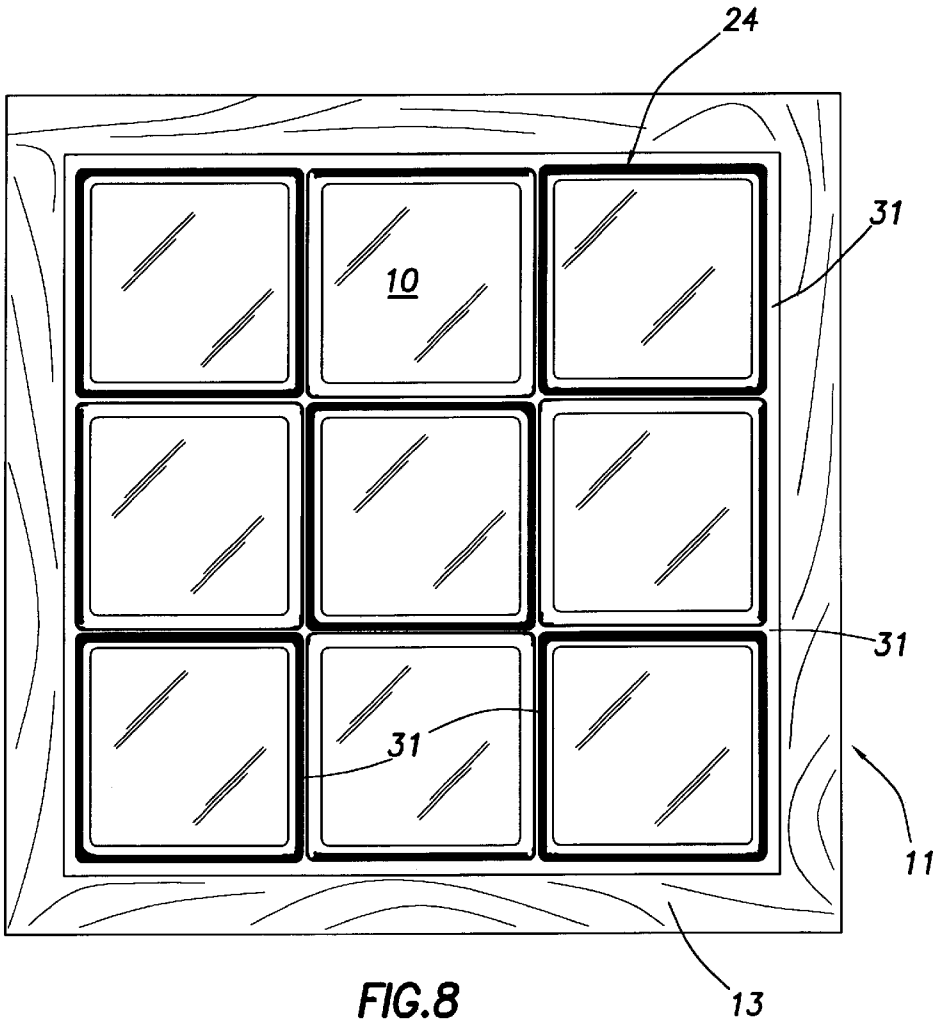
FIG. 8 illustrates the on site construction of a single-tape-joint, three course window unit using the square blocks shown in FIG. 2E.

For modular constructions it is convenient and economical to first "tape-up-blocks" in a shop remote from the actual construction site. Such techniques lend themselves to mass-production. Prepared taped-up blocks can be transported to a remote construction site for assembly into a desired wall, window, shower or other building unit 11 (FIGS. 6,8).

For such modular purposes, appropriately sized flexible, light-weight, elongated, pressure-activatable, individual, adhesive tape strips 24 (FIGS. 4A–4H) are precut or die-cut from sheets or from rolls 9 (FIG. 1) of adhesive tapes 22 to correspond to the dimensional requirements of rim faces 18.

Each prepared tape strip 24 (FIGS. 4A–4H) has a tacky adhesive interior skin 26 and an exterior skin 26' that is covered by a paper release liner 28 (FIG. 1) to protect the skin 26' from dust and other contaminants.

Figure 7:
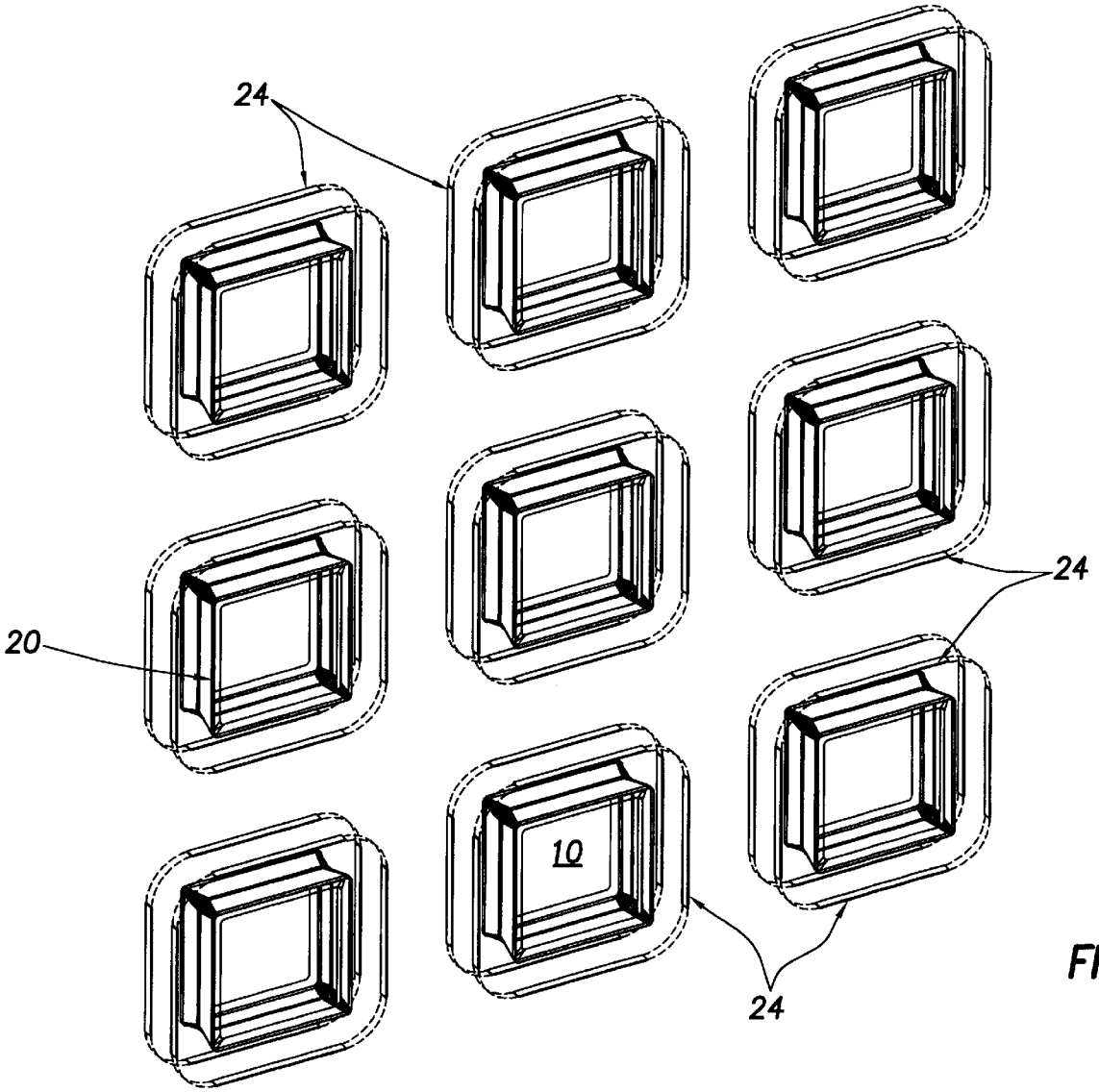
FIG. 7 is an exploded view of the blocks within the double-tape-joint window unit shown in FIG. 6.

A strip's width dimension is selected to fit the width of its corresponding rim faces 18. Its thickness is selected to correspond to the desired width of its block joint 30 or 31 (FIGS. 6–8). Each joint 30 contains a pair of back-to-back tape strips 24, while each joint 31 contains a single tape strip 24 so that the tape strips are substantially entirely confined inside the tape joints. The length of each strip 24 is selected to correspond to the length of rim faces 18 extending from the block's lateral faces 12.

The bonding of an adhesive skin 26 to a rim face 18 involves two steps:

(a) briefly and properly applying an initial sufficient pressure force represented by a horizontal vector force H (FIGS. 4D, 6) or by a vertical vector force V applied perpendicularly to the pressure-activatable skin 26 to initiate its curing and adhesion to rim face 18, and (b) maintaining the applied pressure for a relatively short time period in order to allow the curing to create a permanent bond between the skin and the rim face.

The bond strength will correspond to the strength and performance of the adhesive matrix. When an adhesive skin 26 is activated, under a briefly applied pressure stress, it softens and still remains fairly elastic and tacky so that, during a block assembly, strip 24 will temporarily hold a block 10 in its desired position and will conform and adhere to the rim's face 18 and to any irregularities therein.

After a relatively short time interval, the adhesive's elasticity decreases sharply until it reaches its desired cured or thermoset state, resulting in a complete optimum adhesive bond between the abutting adhesive skin 26' and a rim face 18 of an adjacent abutting block, or in a bond to a rough sill, frame, or other base foundation 13 (FIGS. 6, 8), or to an abutting adhesive skin 26'.

The above adhesive bonding steps (a) and (b) are repeated as many times as needed to create all modular adhesive double-tape block joints 30 or single-tape block joints 31 required for erecting a single or multi-tier unit 11.

It will be appreciated that this adhesive curing process is relatively fast (compared to cement curing) even under varying temperature, humidity and low-to-high pressure environments.

The adhesive tape strips 24 serve as the sole bonding means for adhesively inter-connecting abutting rim faces 18 of block side faces 14 and forming therewith adhesive inter-block joints 30, 31 whose width substantially corresponds to the thickness of the cured adhesive strips 24, and whose strength corresponds to the strength and performance of the adhesive's matrix.

Obviously, before adhesive skins 26 and 26' can be adhesively bonded to one another, or to rim faces 18, or to a rough sill, frame, or other base foundation 13 (FIGS. 6, 8), their protective paper liners 28 need to be peeled off to expose their underlying adhesive skins 26'. Obviously also, this can be accomplished at a remote workshop as well as on a job site whichever is most convenient.

In a single-tape construction, taping-up a rim face 18 involves bonding to the rim face the interior skin 26 of a single adhesive tape strip 24 FIG. (4) using the two step method, i.e., briefly and properly applying a sufficient initial pressure force to the interior skin 26 perpendicular to the plane of the rim face 18 to initiate adhesion to the rim face, and maintaining the applied pressure for a relatively short time period in order to allow curing to create a permanent bond between the interior skin 26 and the rim face 18. The exterior skin 26' of the tape strip 24 remains covered by its protective cover 28.

Modular construction of single-tape building units 11 at the shop site can be achieved by first bonding the interior skins 26 of single tape strips 24 to alternate rim faces 18 of each block 10.

Construction of a prefabricated unit 11 (FIG. 8) begins by disposing two taped-up blocks 10 side-by-side so as to maintain narrow gaps between their untaped rim faces 18 and their opposite taped rim faces. Then the exterior skin 26' of each tape strip 24 is bonded to its opposite untaped rim face 18 so as to create a single-tape block joint 31. Then other taped-up blocks are added and then bonded in a similar manner until the first "course", (FIG. 6A) or row of unit 11 reaches the desired length and width dimensions.

The adhesive bonding process of an exterior skin 26' is initiated by briefly and properly exerting on the taped-up block a sufficient pressure force, in the direction in which adhesion is required, that is perpendicular to the plane containing the rim face 18, and maintaining the applied pressure for a relatively short time period in order to allow curing to create a permanent bond between the exterior skin 26' and the untaped rim face 18.

Until partial curing is reached, each of the blocks can be slightly adjusted to accommodate proper alignment, that is, to allow each block proper placement with respect to its adjoining blocks.

After laying the first course of blocks (FIG. 6A), a second course of blocks (FIG. 6B) is set up side-to-side, and each subsequent course (FIG. 6C) thereabove, by repeating the steps used to construct the first course, until the desired unit 11 is completed and the single-tape block joints 31 (FIG. 8) are aligned in all directions.

Vertical alignment of the single-tape joints 31 is achieved by matching the alignments of the blocks in the first course (FIG. 6A) and making the necessary adjustments prior to applying the physical forces to the blocks to initiate and complete adhesive curing. However, the pressure forces must now be applied in horizontal and vertical directions, represented in the drawings by vector forces H and V, respectively, perpendicularly to the rim faces 18 within unit 11, so as to initiate and complete the adhesive curing within joints 31.

Modular construction of double-taped units 11 can be achieved in a very similar manner but by bonding the interior skins 26 of single tape strips 24 to all rim faces 18 of each block instead of to alternate rim faces 18 as was done during the construction of a single-tape unit 11.

Construction of a prefabricated unit 11 begins by disposing two taped-up blocks 10 side-by-side (FIG. 6) so as to maintain narrow gaps between their taped rim faces 18.

Then the exterior skin 26' of each tape strip 24 is bonded to its opposite exterior skin 26' so as to create double-tape block joints 30 (FIG. 7). Similarly taped-up blocks are added and then bonded in a similar manner until the first (FIG. 6A) course or row of unit 11 reaches the desired length and width dimensions.

After laying the first course of blocks, a second course of blocks (FIG. 6B) is set up side-to-side, and each subsequent course (FIG. 6C) thereabove, by repeating the steps used to construct the first course, until the desired unit 11 is completed and the double tape block joints 30 are aligned in all directions.

FIGS. 6, 7 and 8 show examples of a practical, prefabricated glass block window unit 11 which has been installed in conventional rough openings and which can be finished using conventional trim elements.

Constructing a building-block unit on site begins by making sure that the rough sill, frame, or other base foundation 13 is level, plumb, and designed to bear the weight of the completed unit 11.

The first course (FIG. 6A), or row of prepared taped-up blocks 10 is bonded directly to the rough sill, frame or other base foundation 13, as well as to adjacent taped-up blocks 10.

The first taped-up block of unit 11 is laid by applying an appropriate pressure force H in the horizontal plane to initiate and complete the adhesive bonding process of the adhesive skins 26 to the rough sill, frame, or other base foundation 13.

Subsequent prepared taped-up blocks are then bonded to adjacent blocks as well as to the rough sill, frame, or other base foundation 13 as above described.

The first course (FIG. 6A) being level, sets the horizontal alignment and establishes the foundation for the alignment of each additional course. Subsequent courses (FIGS. 6A–6C) are added, using the first course as a rough sill and template.

As judged architecturally, aesthetically and structurally, the quality of block units 10 depends to a large extent on the uniform alignment of their building block joints 30 or 31 within a common row, as well as between successive rows in horizontal and vertical directions.

The desirable effects and architectural advantages, associated with the mortarless, relatively light-weight glass and plastic block units 11, should now encourage builders to more extensively use glass and plastic blocks 10.

It will be appreciated that since the tape strips 24 are generally of uniform thickness, consistent alignment of joints 30, 31 in all directions within a completed glass block unit 11 can be readily achieved.

Using the process of this invention, it now becomes economical for do-it-yourselfers to construct glass or plastic block units 11 of uniform appearance and save on expensive labor costs, especially for overhead applications such as skylights which are best suited for adhesively-bonded, relatively light-weight plastic blocks.

The adhesive tape strips 24 increase the speed of laying up units 11, decrease the time required to properly adjust and align the blocks' adhesive joints 30, 31 as they are being assembled in stacked rows.

The number of courses of blocks that can be laid up at a time is increased, due to the lack of concern that the excessive weight of the freshly laid up blocks in the upper rows might squeeze out the tape strips from the joints in the lower rows, as is the case when mortar is used.

Also, since no mortar is being used by the process of this invention, no health hazards are expected from prolonged exposure to installations using adhesive tape strips 24, thus improving on the safety in the work environment and decreasing insurance liability costs.

Although the disclosure hereof is detailed and exact to enable those skilled in the art to practice the invention, the physical embodiments herein disclosed merely exemplify the invention which may be embodied in other specific structures. The scope of the invention is defined in the claims appended hereto.

What we claim is:

1. A constructed self-sustaining building member, comprising in combination a number of adjacent, separate, shaped solids;

a corresponding number of flexible double-sided adhesive tape strips bonding said adjacent shaped solids; and said self-sustaining building member having a pattern of adhesive tape joints between said adjacent shaped solids, and said adhesive tape strips being substantially entirely confined inside said joints.

2. The self-sustaining building member according to claim 1, wherein said self-sustaining building member is a wall.

3. The self-sustaining building member according to claim 2, wherein said shaped solids are building blocks.

4. The self-sustaining building member according to claim 3, wherein said building blocks are glass blocks.

5. The self-sustaining building member according to claim 4, wherein each glass block has spaced-apart front and rear faces, and each face has peripheral edge surfaces; and said adhesive tape strips bonding adjacent edge surfaces.

6. The self-sustaining building member according to claim 3, wherein said building blocks are made of materials used for constructing three-dimensional building members of various shapes.

7. The self-sustaining building member according to claim 1, wherein said adhesive tape strips are pressure-responsive.

8. The self-sustaining building member according to claim 1, wherein said self-sustaining building member is load bearing.

9. The self-sustaining building member according to claim 1, wherein said adhesive tape strips fill the interior volumes of their joints and bond their respective adjacent surfaces of said shaped solids; and each tape joint has a width substantially corresponding to the thickness of its adhesive tape strip.

10. The self-sustaining building member according to claim 1, wherein one adhesive side of said tape strip bonds one surface of one shaped solid, and the opposite adhesive side of said tape strip bonds an opposite surface of an adjacent shaped solid thereby forming said tape joint.

11. The self-sustaining building member according to claim 10, wherein said adhesive on said tape strips consists of an acrylic, copolimeric, pressure-responsive adhesive matrix and of glass microbubbles dispersed throughout the matrix.

12. A building process comprising the steps of a) selecting a number of adjacent, separate, shaped solids as needed for constructing a self-sustaining building member;

b) selecting a corresponding number of flexible double-sided adhesive tape strips; and c) bonding said shaped solids with said adhesive tape strips so as to construct said self-sustaining building member with a pattern of adhesive tape joints between said adjacent shaped solids, and with said adhesive tape strips being substantially entirely confined inside said joints.

13. The building process according to claim 12, wherein said self-sustaining building member is a wall.

14. The building process according to claim 13, wherein said shaped solids are building blocks.

15. The building process according to claim 14, wherein said building blocks are glass blocks.

16. The building process according to claim 15, wherein each glass block has spaced-apart front and rear faces, and each face has peripheral edge surfaces; and said adhesive tape strips bonding adjacent edge surfaces.

17. The building process according to claim 14, wherein said building blocks are made of materials used for constructing three-dimensional building members of various shapes.

18. The building process according to claim 12, wherein said adhesive tape strips are pressure-responsive.

19. The building process according to claim 12, wherein said self-sustaining building member is load bearing.

20. The building process according to claim 12, and said adhesive tape strips fill the interior volumes of their joints and bond their respective adjacent surfaces of said shaped solids; and each tape joint has a width substantially corresponding to the thickness of its adhesive tape strip.

21. The building process according to claim 12, wherein one adhesive side of said tape strip bonds one surface of one shaped solid, and the opposite adhesive side of said tape strip bonds an opposite surface of an adjacent shaped solid thereby forming said tape joint.

22. The building process according to claim 21, wherein said adhesive on said tape strips consists of an acrylic, copolimeric, pressure-responsive adhesive matrix and of glass microbubbles dispersed throughout the matrix.

* * * * *